US010396478B2

(12) United States Patent
Ho

(10) Patent No.: US 10,396,478 B2
(45) Date of Patent: Aug. 27, 2019

(54) ELECTRICAL CONNECTOR

(71) Applicant: Molex, LLC, Lisle, IL (US)

(72) Inventor: Yi-Tse Ho, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/328,681

(22) PCT Filed: Aug. 7, 2015

(86) PCT No.: PCT/IB2015/001858

§ 371 (c)(1),
(2) Date: Jan. 24, 2017

(87) PCT Pub. No.: WO2016/020761

PCT Pub. Date: Feb. 11, 2016

(65) Prior Publication Data

US 2017/0222342 A1 Aug. 3, 2017

(30) Foreign Application Priority Data

Aug. 8, 2014 (CN) ..... 2014 1 0389891

(51) Int. Cl.
*H01R 12/71* (2011.01)
*H01R 24/60* (2011.01)
(Continued)

(52) U.S. Cl.
CPC ..... *H01R 12/71* (2013.01); *H01R 13/627* (2013.01); *H01R 13/6581* (2013.01);
(Continued)

(58) Field of Classification Search
CPC .. H01R 12/714; H01R 12/722; H01R 12/721; H01R 13/6585; H01R 13/6594; H01R 13/6595; H01R 13/6581; H01R 24/60
See application file for complete search history.

(56) References Cited

U.S. PATENT DOCUMENTS 7,137,837 B2 11/2006 Chen et al.
7,670,156 B2 3/2010 Chen
(Continued)

FOREIGN PATENT DOCUMENTS

CN 203445352 U 2/2014
JP 06-073882 U 10/1994
(Continued)

*Primary Examiner* — Edwin A. Leon
*Assistant Examiner* — Oscar C Jimenez
(74) *Attorney, Agent, or Firm* — Molex, LLC

(57) ABSTRACT

An electrical connector has an insulative body, a group of first conductive terminals and a group of second conductive terminals fixed to the insulative body, a grounding metal plate and an outer shielding shell. A front part of the shell forms a first mating cavity and a rear part of the shell forms a second mating cavity. An insertion space is formed between elastic extending arms of the first terminal group and elastic extending arms of the second terminal group. An electrical connector combination, which includes the electrical connector and a circuit board, is further provided. An inserted portion of the circuit board can be correspondingly inserted into the insertion space and can be elastically interposed by the elastic extending arms of the first terminal group and the elastic extending arms of the second terminal group so as to be correspondingly electrically connected.

24 Claims, 10 Drawing Sheets

(51) Int. Cl.

| | |
|---|---|
| ***H01R 24/62*** | (2011.01) |
| ***H01R 107/00*** | (2006.01) |
| ***H01R 13/627*** | (2006.01) |
| ***H01R 13/6581*** | (2011.01) |
| ***H01R 13/6585*** | (2011.01) |
| ***H01R 13/6595*** | (2011.01) |

(52) U.S. Cl.
CPC ..... *H01R 13/6585* (2013.01); *H01R 13/6595* (2013.01); *H01R 24/60* (2013.01); *H01R 24/62* (2013.01); *H01R 2107/00* (2013.01)

(56) References Cited

U.S. PATENT DOCUMENTS 8,371,861 B1 2/2013 Cina et al.
8,684,769 B2 4/2014 Kao et al.
8,998,632 B2 4/2015 Golko et al.
9,281,626 B2 * 3/2016 Lin ..... H01R 13/6581
9,312,641 B2 4/2016 Wang et al.
9,425,565 B1 * 8/2016 Chien ..... H01R 12/707
9,548,568 B2 * 1/2017 Miyoshi ..... H01R 13/428
9,577,385 B1 * 2/2017 Lin ..... H01R 13/6585
2003/0207600 A1 * 11/2003 Ho ..... H01R 12/725 439/79
2004/0127092 A1 7/2004 Yamada et al.
2006/0040556 A1 2/2006 Neer et al.
2007/0099514 A1 5/2007 Ito
2009/0004889 A1 1/2009 Sakamoto et al.
2009/0104818 A1 * 4/2009 Wu ..... H01R 12/716 439/638
2010/0184329 A1 * 7/2010 Hou ..... H01R 13/6658 439/607.01
2011/0151701 A1 * 6/2011 Ngo ..... H01R 13/6273 439/327
2012/0302072 A1 * 11/2012 Hsu ..... H01R 12/725 439/61
2013/0178075 A1 * 7/2013 Hsueh ..... H01R 12/721 439/62
2013/0330976 A1 12/2013 Simmel et al.
2014/0220827 A1 8/2014 Hsu et al.
2014/0370751 A1 * 12/2014 Zheng ..... H01R 13/6581 439/607.35
2015/0200504 A1 * 7/2015 Little ..... H01R 24/60 439/345
2015/0229077 A1 * 8/2015 Little ..... H01R 12/724 439/78
2015/0244111 A1 * 8/2015 Ju ..... H01R 13/6585 439/607.05
2015/0255905 A1 * 9/2015 Little ..... H01R 13/6658 439/78
2015/0340821 A1 * 11/2015 Yen ..... H01R 13/6581 439/607.01
2016/0006148 A1 * 1/2016 Chung ..... H01R 12/51 439/83
2016/0020537 A1 * 1/2016 Ju ..... H01R 24/78 439/83
2016/0020569 A1 * 1/2016 Ju ..... H01R 24/78 439/607.01
2016/0020572 A1 * 1/2016 Ju ..... H01R 24/78 264/272.14
2016/0043512 A1 * 2/2016 Kao ..... H01R 12/57 439/620.22
2016/0064879 A1 * 3/2016 Yen ..... H01R 24/78 439/607.01
2016/0079712 A1 * 3/2016 Chung ..... H01R 13/6581 439/607.55
2017/0040724 A1 * 2/2017 Little ..... H01R 12/724
2017/0040750 A1 * 2/2017 Little ..... H01R 13/6597
2017/0054258 A1 * 2/2017 Little ..... H01R 24/60
2017/0110821 A1 * 4/2017 Oyake ..... H01R 13/405
2017/0162976 A1 * 6/2017 Zhao ..... H01R 4/02
2017/0214193 A1 * 7/2017 Tsai ..... H01R 24/64
2017/0271820 A1 * 9/2017 Ho ..... H01R 13/6585
2017/0271822 A1 * 9/2017 Zhang ..... H01R 13/6594
2017/0288345 A1 * 10/2017 Kao ..... H01R 13/6596
2017/0302013 A1 * 10/2017 Ju ..... H01R 24/78
2017/0302014 A1 * 10/2017 Ju ..... H01R 24/78
2017/0302035 A1 * 10/2017 Ju ..... H01R 13/6585

FOREIGN PATENT DOCUMENTS

JP 2002-216877 A 8/2002
JP 3111031 U 7/2005
JP 2005-302362 A 10/2005
JP 2010-055798 A 3/2010
JP 4883592 B2 2/2012

* cited by examiner

ELECTRICAL CONNECTOR

RELATED APPLICATIONS

This application is a national stage application of International Application No. PCT/IB2015/001858, filed Aug. 7, 2015, which claims priority to Chinese Patent Application No. 201410389891.4, filed Aug. 8, 2014, which are both incorporated herein by reference in their entireties.

TECHNICAL FIELD

The present disclosure relates to an electrical connector, and particularly relates to a connecting configuration that an electrical connector is combined with a circuit board.

BACKGROUND ART

Chinese patent application CN201320378153.0 discloses an electrical connector which comprises an insulative body and a group of first terminals and a shielding member which are fixed to the insulative body, the insulative body comprises a base portion and a tongue extending forwards, the tongue has a first surface and a second surface which are provided oppositely, the first terminals are exposed on the first surface, the shielding member is provided to the tongue and is positioned between the first surface and the second surface, the first terminals comprise a grounding terminal, the grounding terminal is provided with a contact portion protruding toward the shielding member and contacting the shielding member.

Tail portions of the terminals in an upper row of the electrical connector are soldered to a circuit board by surface soldering. On the one hand, the tail portions of the terminals in the upper row horizontally extend rearwards out of a first insulator, therefore such a tail portion does not have elasticity in design, so that some of the terminals in the upper row cannot be soldered to the circuit board easily due to poor coplanarity of the tail portions of the terminals when the electrical connector is soldered to the circuit board, which results in empty soldering. On the other hand, high temperature during soldering easily has negative effect on electrical performances of the electrical connector, solder may be cracked, which may further result in a poor electrical connection. Moreover, terminals in a lower row of the electrical connector are rigidly connected to the circuit board via straight insert soldering, which may result in that the electrical connector cannot precisely be aligned with an opening of the casing of an electronic device (such as a mobile phone) easily due to manufacturing tolerance.

SUMMARY

A technical problem to be resolved by the present disclosure is to provide an electrical connector and an electrical connector combination which may reliably prevent empty soldering, allow the electrical connector to be suitably adjusted in position and in turn improve mounting flexibility so as to overcome the deficiency existing in the prior art.

In view of the above technical problems, the present disclosure provides an electrical connector which comprises: an insulative body comprising a base, a tongue extending forwards from the base and two side walls extending rearwards respectively from two sides of the base, the tongue has a first mating surface and a second mating surface which are opposite along an up-down direction; a group of first conductive terminals, each first conductive terminal comprises a fixed portion fixed in the base, a plate-like extending arm extending forwards from the fixed portion to the tongue and an elastic extending arm extending rearwards from the fixed portion and extending out of the base, the plate-like extending arm is exposed on the first mating surface of the tongue, the elastic extending arm is received between the two side walls; a group of second conductive terminals, each second conductive terminal comprises a fixed portion fixed in the base, a plate-like extending arm extending forwards from the fixed portion to the tongue and an elastic extending arm extending rearwards from the fixed portion and extending out of the base, the plate-like extending arm is exposed on the second mating surface of the tongue, the elastic extending arm is received between the two side walls, an insertion space is formed between the elastic extending arms of the first conductive terminals and the elastic extending arms of the second conductive terminals; a grounding metal plate provided in the tongue and spacing the first conductive terminals apart from the second conductive terminals; and an outer shielding shell fixed on the insulative body, defining a first mating cavity formed by surrounding an outer space of the tongue, and defining a second mating cavity formed by surrounding the two side walls.

In view of the above technical problems, the present disclosure further provides an electrical connector combination which comprises the electrical connector and a circuit board combined with each other. The circuit board is provided with an inserted portion, the inserted portion has two mating surfaces opposite along the up-down direction, each of the two mating surfaces is provided with a group of conductive pads; the inserted portion of the circuit board is correspondingly inserted into the insertion space of the second mating cavity of the electrical connector, the conductive pads on two mating surfaces of the inserted portion are elastically contacted by the elastic extending arms of the first conductive terminals and the elastic extending arms of the second conductive terminals so as to be correspondingly electrically connected.

In comparison with the prior art, in the electrical connector and the electrical connector combination of the present disclosure, the electrical connector establishes an electrical connection with the circuit board via the elastic extending arms and the conductive pads, such an elastic contact may reduce effect from coplanarity tolerance, enhance connection reliability of the elastic extending arms and the conductive pads, and prevent empty soldering of the terminals; also, such an elastic contact may not require soldering between the conductive terminals and the circuit board, in turn may reduce negative effects on electrical performances of the electrical connector due to high temperature of soldering, and may eliminate risk of solder cracking; in addition, such an elastic contact can allow the electrical connector to be provided to the circuit board in form of floating, may slightly adjust the electrical connector and the circuit board relative to each other in position when the electrical connector is locked to the circuit board, which is beneficial to precise alignment of the electrical connector with the opening of the casing of the electronic device, and in turn provide mounting flexibility.

DETAILED DESCRIPTION OF THE PREFERRED EMBODIMENTS

Figure 1:
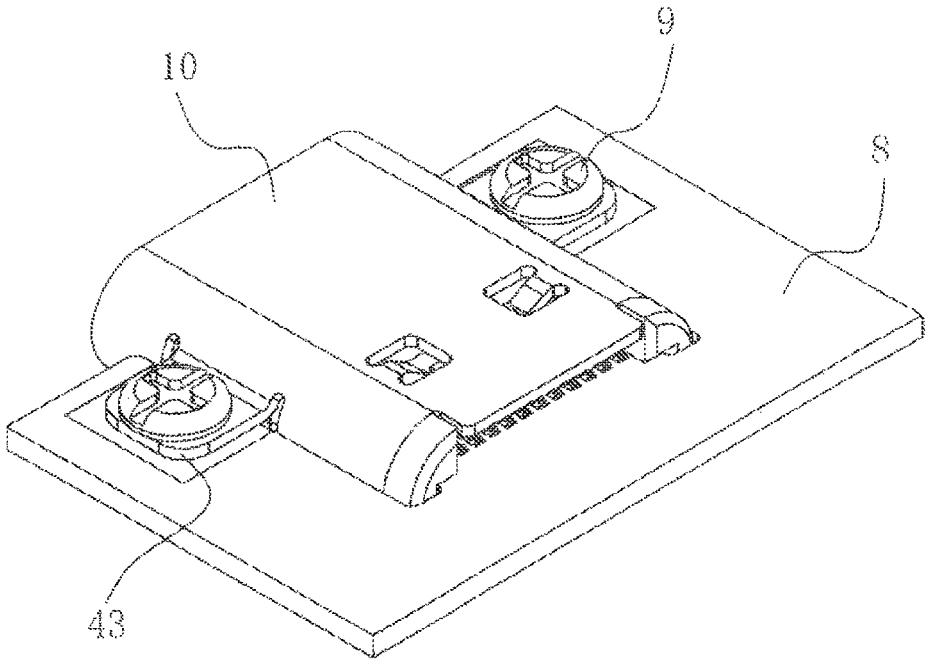
FIG. 1 is a perspective view of an embodiment of an electrical connector combination of the present disclosure.
Figure 2:
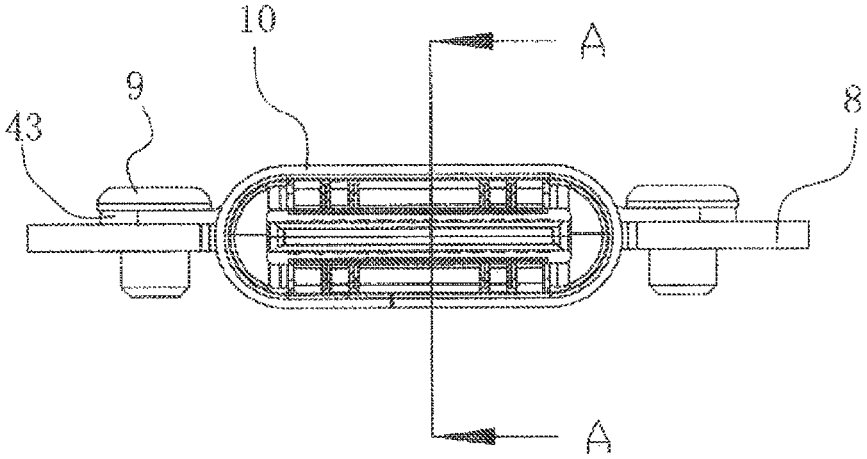
FIG. 2 is a front view of the embodiment of the electrical connector combination of the present disclosure.

While the present disclosure may be susceptible to embodiment in different forms, there is shown in the Figures, and will be described herein in detail, specific embodiments, with the understanding that the disclosure is to be considered an exemplification of the principles of the present disclosure, and is not intended to limit the present disclosure to that as illustrated.

As such, references to a feature are intended to describe a feature of an embodiment of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the illustrated embodiments, directional representations (such as up, down, left, right, front, rear and the like) used for explaining the structure and movement of the various elements of the present disclosure, are not absolute, but relative. These representations are appropriate when the elements are in the position shown in the Figures. If the description of the position of the elements changes, however, it is assumed that these representations are to be changed accordingly.

Hereinafter, embodiments of the present disclosure will be described in detail in combination with the Figures.

Referring to FIG. 1 to FIG. 4, an embodiment of an electrical connector combination of the present disclosure is illustrated. The connector combination comprises an electrical connector 10 and a circuit board 8 combined with the electrical connector 10. In the embodiment, the electrical connector 10 is mounted to circuit board 8 in a manner of sinking. The electrical connector 10 comprises a combined body 100, a grounding metal plate 3 fixed in the combined body 100, an outer shielding shell 4 surrounding the combined body 100 and an inner shielding shell 5 positioned in an inner side of the outer shielding shell 4 and attached on a surface of the combined body 100.

A locking arm 43 transversally extends outwards from each of two sides of the outer shielding shell 4. Each locking arm 43 is provided with a locking hole 431. The circuit board 8 comprises a base portion 81 and an inserted portion 82 provided in front of the base portion 81. The inserted portion 82 has two mating surfaces opposite along an up-down direction, each mating surface is provided with a group of conductive pads 821. The conductive pads 821 can contact with the conductive terminals 12, 22 and the grounding metal plate 3 of the electrical connector 10 so as to establish an electrical connection therebetween.

The circuit board 8 is further provided with two mounting portions 83 respectively positioned at two sides of the inserted portion 82 and respectively extending forwards. A receiving channel 85 is formed between each mounting portion 83 and the inserted portion 82. When the circuit board 8 is mated with the electrical connector 10, the two receiving channels 85 may be used to respectively receive structures at two sides of a rear part of the electrical connector 10. In other words, a front edge of the circuit board 8 is recessed rearwards with a mounting groove 84, the inserted portion 82 protrudes forwards in the middle of the mounting groove 84. Each mounting portion 83 is provided with a mounting hole 86 corresponding to the locking hole 431. The electrical connector 10 is locked to the circuit board 8 via fasteners 9 (such as blots) passing through the corresponding mounting holes 86 and the corresponding locking holes 431.

A front part of the electrical connector 10 is enclosed to form a first mating cavity 41 for insertion of another mating connector (not shown). A rear part of the electrical connector 10 is formed with a second mating cavity 42 for insertion of the inserted portion 82 and two positioning grooves 108 positioned at two sides of the second mating cavity 42. When the inserted portion 82 of the circuit board 8 is inserted into the second mating cavity 42, two side edges of the inserted portion 82 will be respectively inserted into the two positioning grooves 108, so as to function as positioning and prevent loosening.

Referring to FIG. 5 to FIG. 13, the combined body 100 comprises a first terminal module 1 and a second terminal module 2 combined with each other. The first terminal module 1 has a first insulative piece 11 and a group of first conductive terminals 12 embedded in the first insulative piece 11. The first insulative piece 11 has a first base portion 111, a first tongue portion 112 extending forwards from a front side of the first base portion 111 and two first extending arms 113 respectively extending rearwards from two sides of the first base portion 111

The first tongue portion 112 has a first combined surface 1121 facing the second terminal module 2 and a first mating surface 1122 opposite to the first combined surface 1121. Two side surfaces of the first tongue portion 112 close to the rear thereof are respectively formed with two first receiving grooves 114 and two first latching grooves 115 respectively positioned in front of the two first receiving grooves 114. The first combined surface 1121 of the first tongue portion 112 is provided with two first fixing holes 116 and two second fixing holes 117.

A lower part of an inner side of each first extending arm 113 is formed with a first step portion 1131 extending along a front-rear direction. The first step portion 1131 has a bottom surface which is substantially horizontal.

A fixed portion 121 of the first conductive terminal 12 is fixed in the first base portion 111, and a front end of the fixed portion 121 extends forwards out of the first base portion 111 and extends to the first tongue portion 112 to form a plate-like extending arm 122 exposed on the first mating surface 1122, and a rear end of the fixed portion 121 extends rearwards out of the first base portion 111 to form an elastic extending arm 123 for elastically engaging the conductive pad 821 of the circuit board 8.

Specifically, in the embodiment, the elastic extending arm 123 comprises an elastic section 1231 inclinedly extending from front to rear, an engaging section 1232 formed at an end of the elastic section 1231 and a guiding section 1233 further inclinedly extending rearwards from the engaging section 1232. In combination with referring to FIG. 3 and FIG. 8, the engaging section 1232 may elastically abut against the conductive pad 821 on the upper surface of the circuit board 8. Preferably, the engaging section 1232 may slightly slide relative to the conductive pad 821 along the front-rear direction.

The second terminal module 2 and the first terminal module 1 face each other and are combined as an integral piece. The second terminal module 2 has a second insulative piece 21 combined upwards to the first insulative piece 11 and a group of second conductive terminals 22 embedded in second insulative piece 21. The second insulative piece 21 has a second base portion 211 corresponding to the first base portion 111, a second tongue portion 212 extending forwards from a front side of the second base portion 211 and corresponding to the first tongue portion 112 in position, and two second extending arms 213 extending rearwards respectively from two sides of the first base portion 111 and respectively corresponding to the two first extending arms 113 in position.

The second tongue portion 212 has a second combined surface 2121 facing upwards the first combined surface 1121 and a second mating surface 2122 opposite to the second combined surface 2121. Two side surfaces of the second tongue portion 212 are formed with two second receiving grooves 214 respectively corresponding to the two first receiving grooves 114 in position and two second latching grooves 215 respectively corresponding to the two first latching grooves 115 in position. The second combined surface 2121 is provided with two first protruding posts 216 protruding toward the first terminal module 1 and respectively corresponding to the two first fixing holes 116 in position and two second protruding posts 217 protruding toward the first terminal module 1 and corresponding to the two second fixing holes 117 in position.

An upper part of an inner side of each second extending arm 213 is formed with a second step 2131 extending along the front-rear direction and corresponding to the first step portion 1131 in position. The second step 2131 has a top surface which is substantially horizontal. However, a difference of the second step 2131 from the first step portion 1131 lies in that a sink groove 2132 is recessed downwards from a front part of the top surface of the second step 2131.

The second conductive terminals 22 and the first conductive terminals 12 are the same in structure, and the first conductive terminals 12 and the second conductive terminals 22 are provided as facing one to one along the up-down direction and are in 180 degrees rotational symmetry. A fixed portion 221 of the second conductive terminal 22 is fixed in the second base portion 211, and a front end of the fixed portion 221 extends forwards out of the second base portion 211 to form a plate-like extending arm 222 exposed on the second mating surface 2122, and a rear end of the fixed portion 221 extends rearwards out of the second base portion 211 to form an elastic extending arm 223 for elastically engaging the conductive pad 821 of the circuit board 8.

Specifically, in the embodiment, the elastic extending arm 223 comprises an elastic section 2231 inclinedly extending from front to rear, an engaging section 2232 formed at an end of the elastic section 2231 and a guiding section 2233 further inclinedly extending rearwards from the engaging section 2232. In combination with referring to FIG. 3 and FIG. 8, the engaging section 2232 may elastically abut against the conductive pad 821 on the lower surface of the circuit board 8. Preferably, the engaging section 2232 may slightly slide relative to the conductive pad 821 along the front-rear direction.

Figure 3:
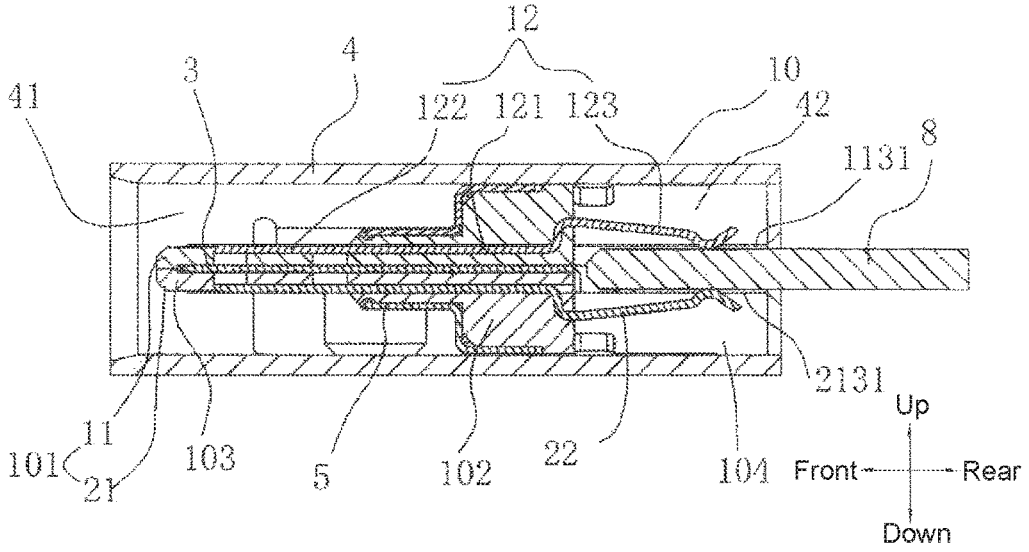
FIG. 3 is a cross sectional view taken along a line A-A of FIG. 2 illustrating a combination between the electrical connector and a circuit board.
Figure 4:
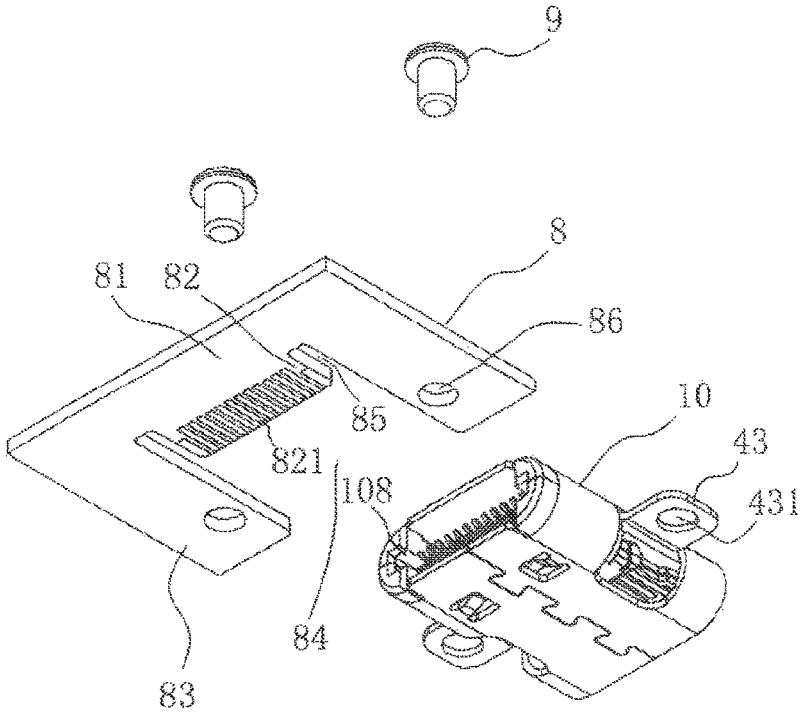
FIG. 4 is an exploded perspective view of the embodiment of the electrical connector combination of the present disclosure illustrating the electrical connector, the circuit board and fasteners of the electrical connector combination.
Figure 5:
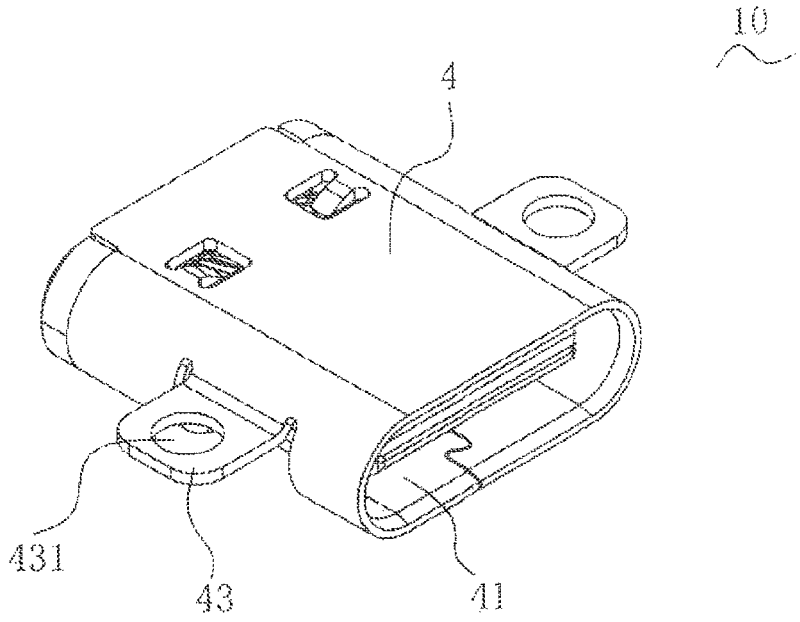
FIG. 5 is a perspective view of the electrical connector of the present disclosure.
Figure 6:
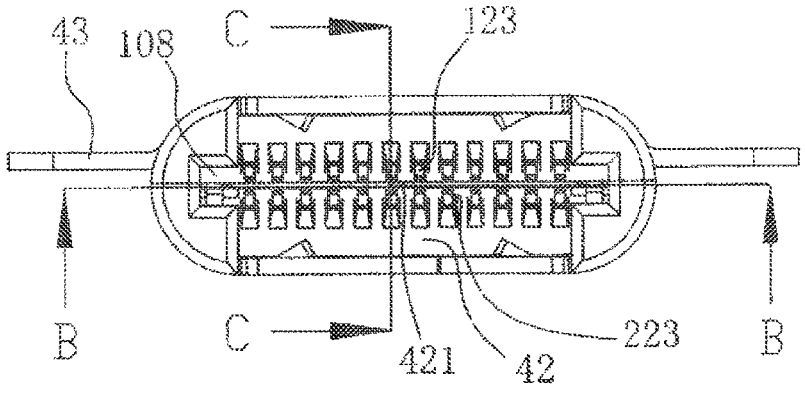
FIG. 6 is a rear view of the electrical connector of the present disclosure.
Figure 8:
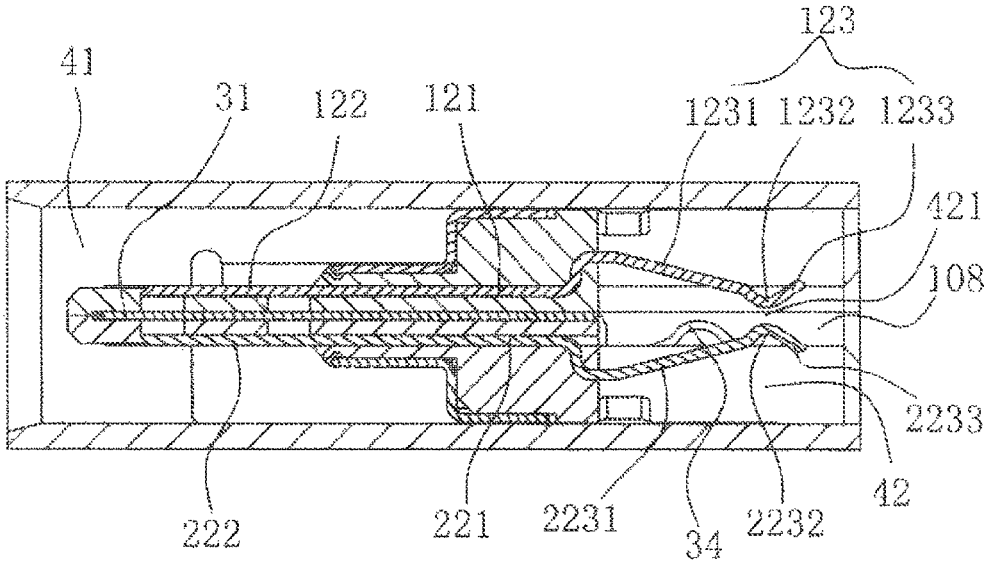
FIG. 8 is a cross sectional view taken along a line C-C of FIG.6 illustrating an inner portion of the electrical connector.
Figure 9:
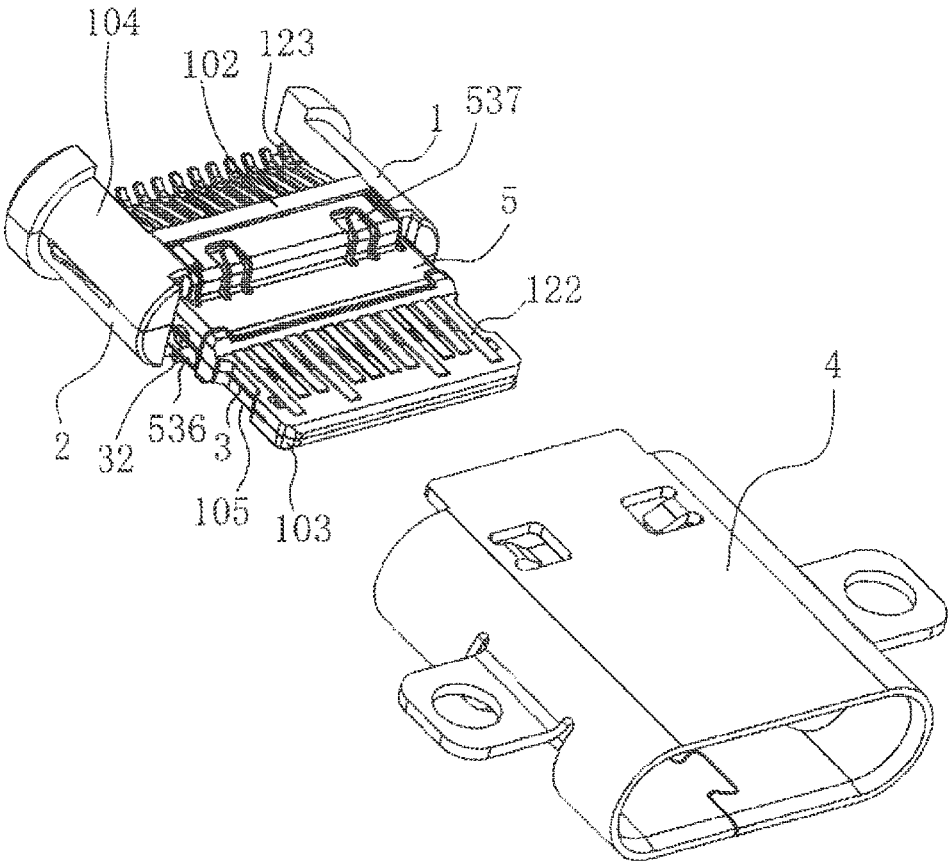
FIG. 9 to FIG. 13 are exploded perspective views of the electrical connector of the present disclosure illustrating components of the electrical connector.

In combination with referring to FIG. 3 and FIG. 8, an insertion space 421 is formed between the elastic extending arms 123 of the first conductive terminals 12 and the elastic extending arms 223 of the second conductive terminals 22, so as to allow the inserted portion 82 of the circuit board 8 to be correspondingly inserted. The elastic section 1231 of the first conductive terminal 12 and the lower elastic section 2231 of the second conductive terminal 22 extend gradually close to each other along the front-rear direction, such a structure design is beneficial to clip the circuit board 8 tightly so as to attain a good performance in electrical connection. The guiding section 1233 of the first conductive terminal 12 and the guiding section 2233 of the second conductive terminal 22 extend gradually far way from each other along the front-rear direction. Such a structure, that the guiding sections 1233, 2233 expand rearwards, is beneficial to guide insertion of the circuit board 8. It should be noted that, a dimension of the insertion space 421 along the up-down direction is varied, that is to say, before the circuit board 8 is inserted, the elastic extending arms 123, 223 are in a state that they extend freely, the dimension of the insertion space 421 along the up-down direction (that is, the shortest distance between the two engaging sections 1232, 2232) is minimum; after the circuit board 8 is inserted, the elastic extending arms 123, 223 are in a state that they are expended due to a force from the circuit board 8, the dimension of the insertion space 421 along the up-down direction becomes large.

When the first terminal module 1 and the second terminal module 2 are combined with each other, the first insulative piece 11 and the second insulative piece 21 are combined with each other to form an insulative body 101 of the electrical connector 10, the first base portion 111 and the second base portion 211 are combined with each other to form a base 102 of the insulative body 101, the first tongue portion 112 and the second tongue portion 212 are combined with each other to form a tongue 103 extending forwards from the base 102, the two first extending arms 113 and the two second extending arms 213 are combined with each other to form two side walls 104 extending rearwards respectively from two sides of the base 102.

Figure 10:
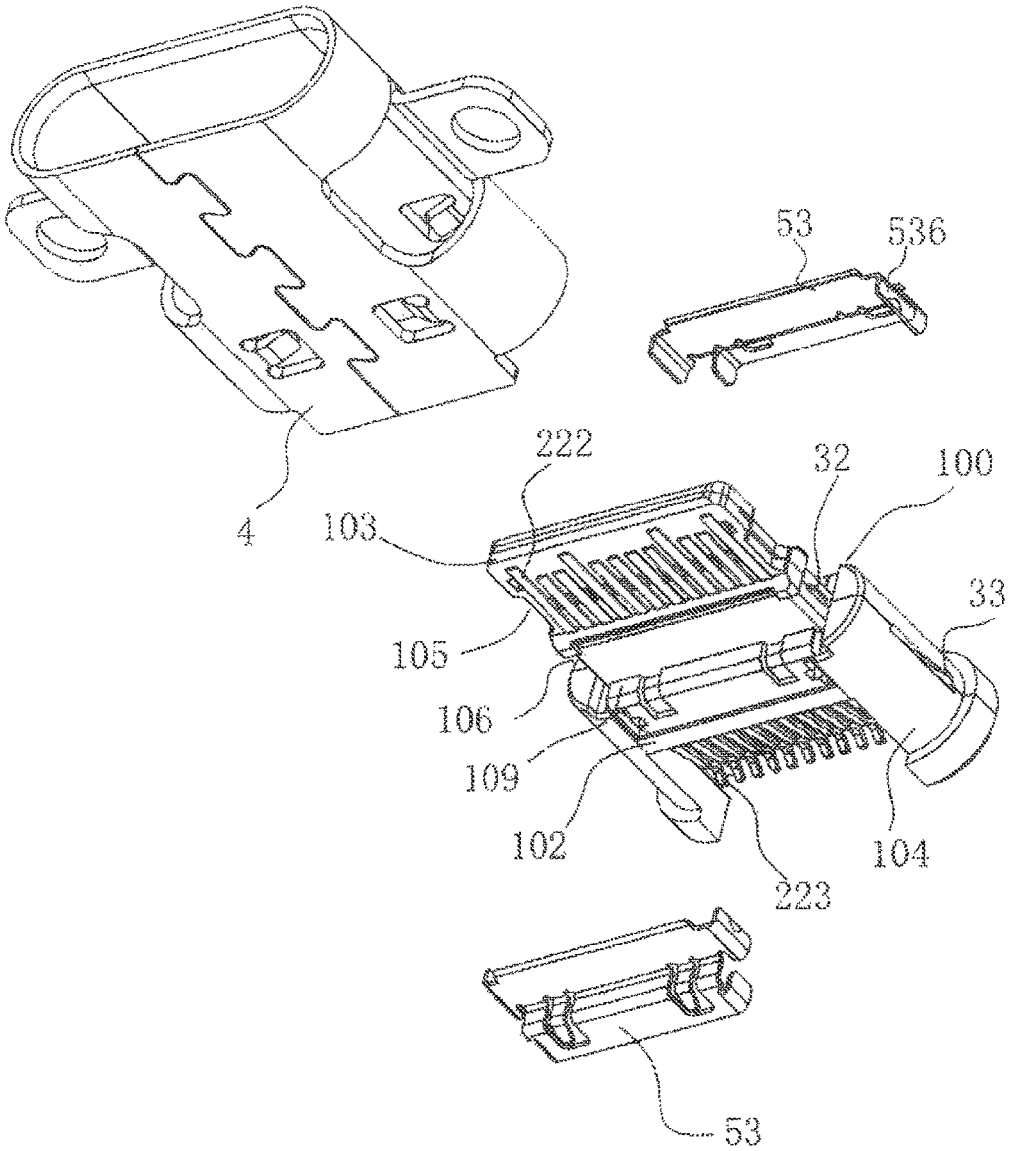
Figure 11:
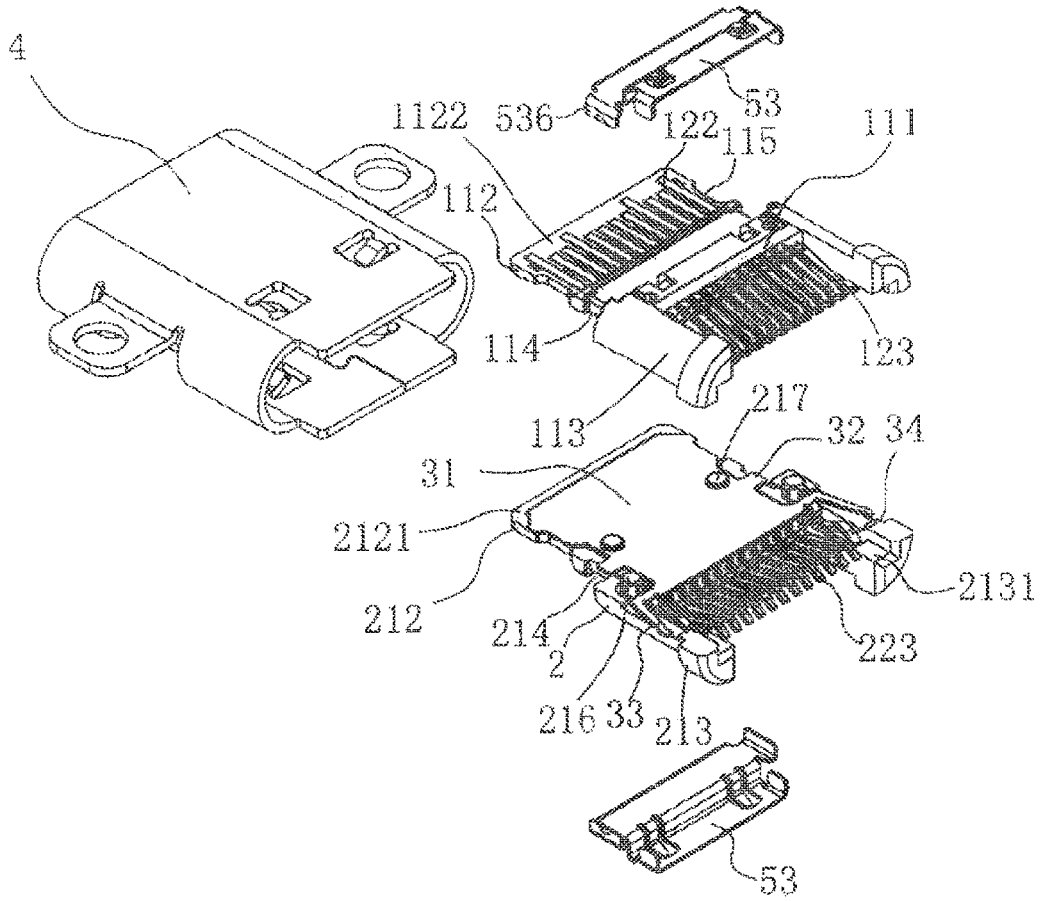
Figure 12:
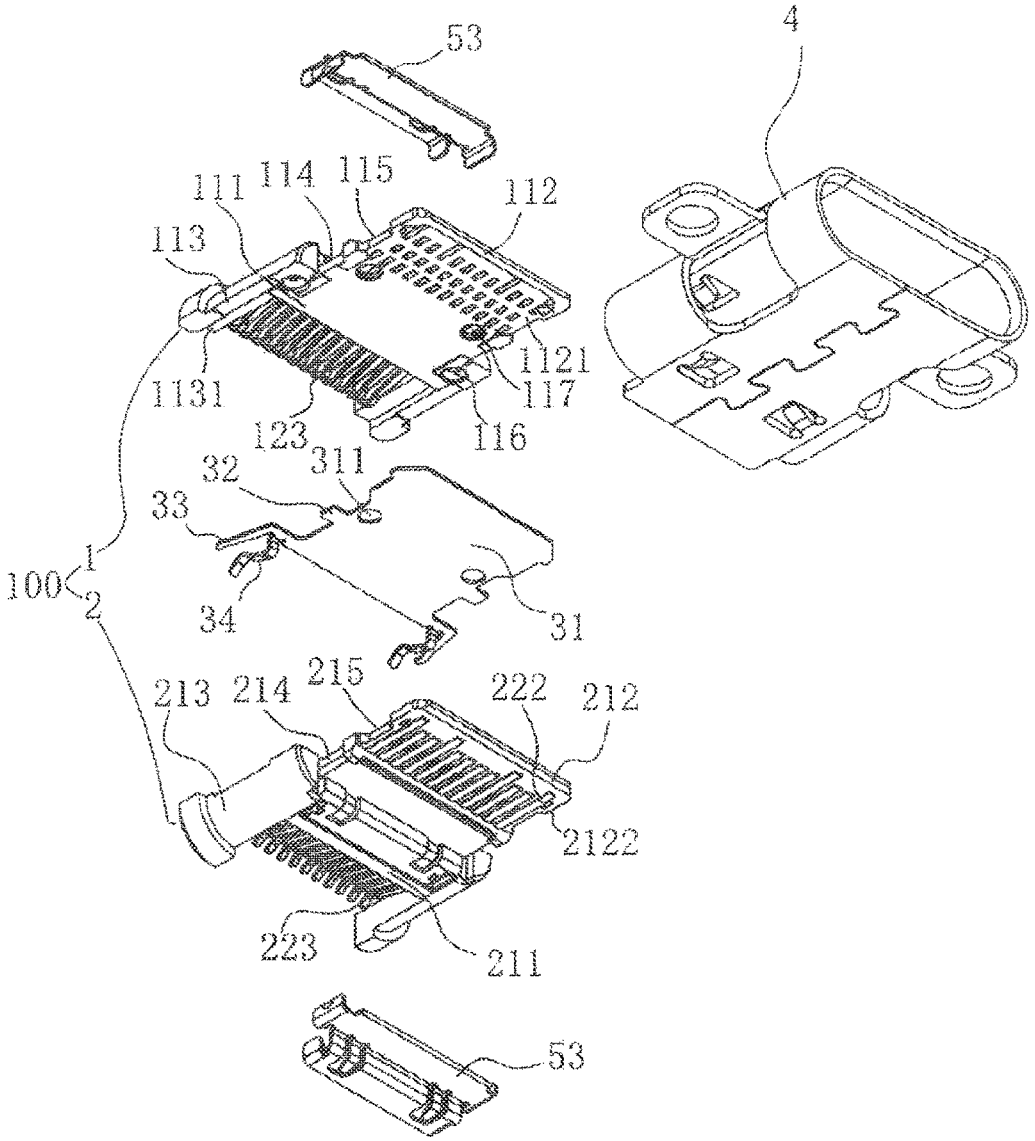
Figure 13:
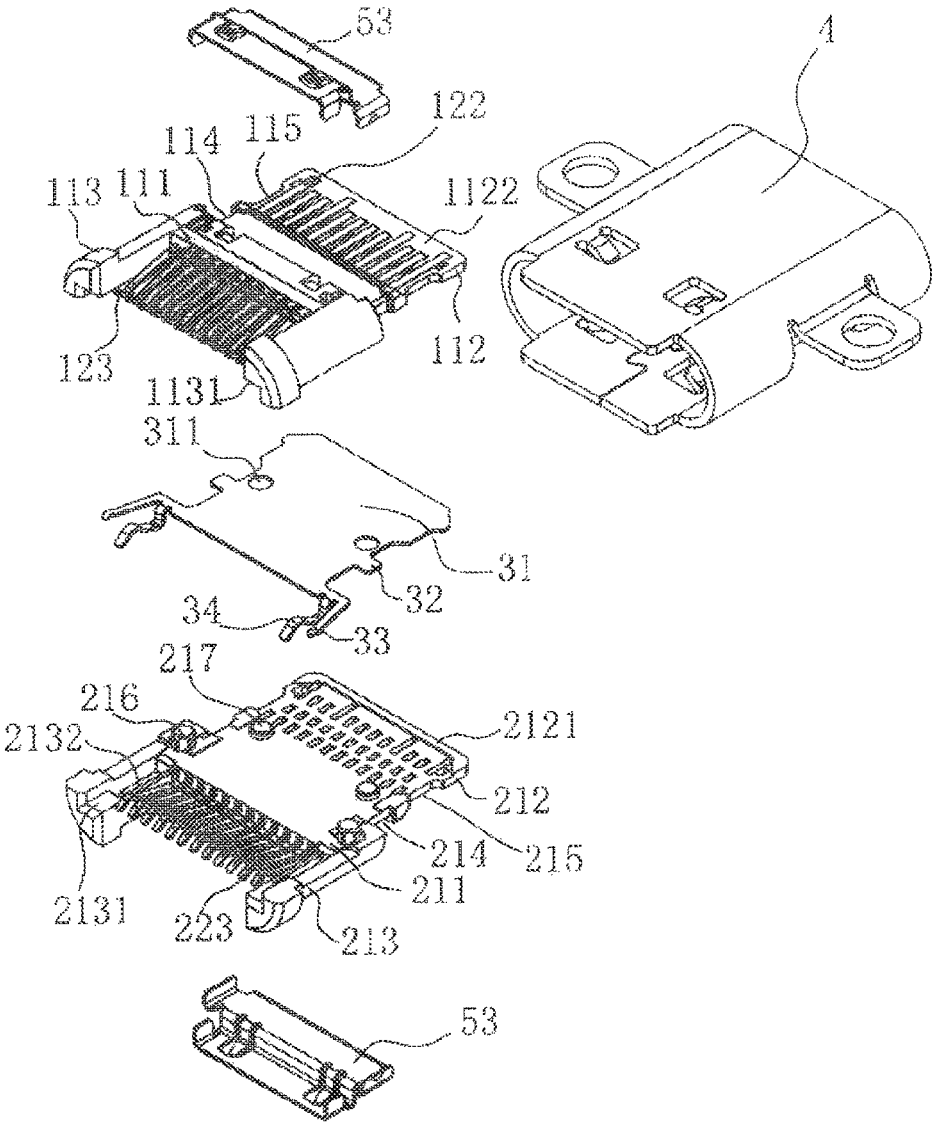

At the same time, the first receiving groove 114 and the second receiving groove 214 are combined with each other to form a receiving groove 106 of the insulative body 101, the first latching groove 115 and the second latching groove 215 are combined with each other to form a latching groove 105 of the insulative body 101. The first step portion 1131 and the second step 2131 are combined with each other to form a positioning groove 108 on the side wall 104 of the insulative body 101. A vertical distance between a bottom surface and a top surface of each of the two positioning grooves 108 is slightly larger than a thickness of the circuit board 8. The two positioning grooves 108 and the insertion space 421 are positioned at the same height level and are communicated with each other. Referring to FIG. 10, the base 102 of the insulative body 101 has a front surface 109 which is substantially vertical.

The grounding metal plate 3 is interposed between the first terminal module 1 and the second terminal module 2, such a structure is easier to manufacture and assemble. With the grounding metal plate 3, the tongue 103 formed by combining the first tongue portion 112 with the second tongue portion 212 may be enhanced in structure strength, and high frequency signals crosstalk between the first conductive terminals 12 and the second conductive terminals 22 is reduced. Two opposite surfaces of the grounding metal plate 3 respectively attach on the first combined surface 1121 of the first tongue portion 112 and the second combined surface 2121 of the second tongue portion 212.

The grounding metal plate 3 comprises a main body 31 and a first connecting portion 32, a second connecting portion 33 and two elastic contact arms 34 which extend from the main body 31. The main body 31 is provided in the tongue 103 and spaces the first conductive terminals 12 apart from the second conductive terminals 22.

Figure 7:
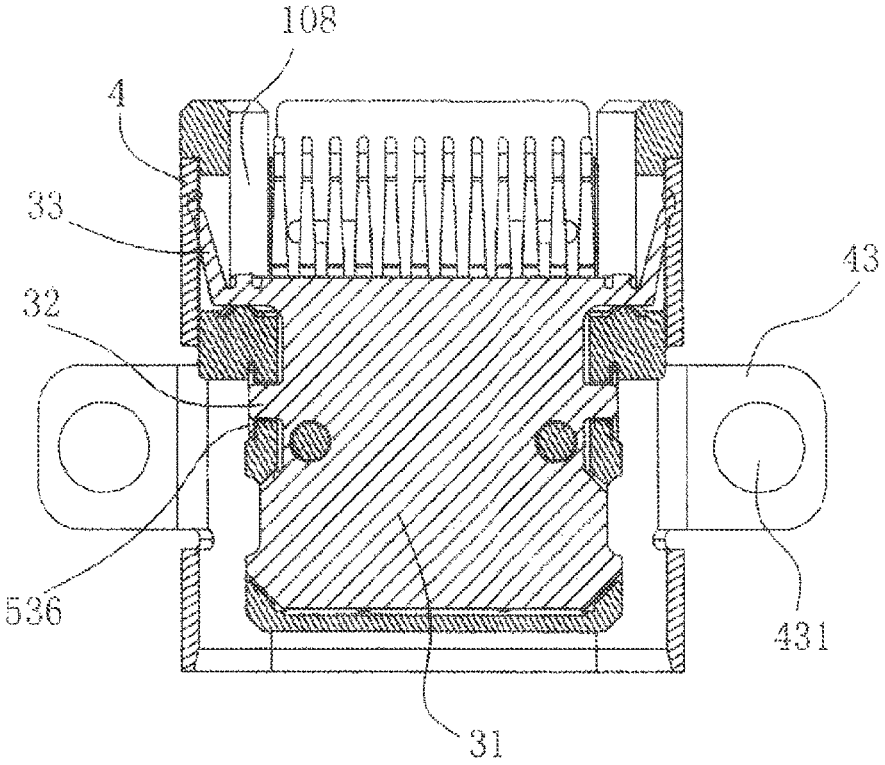
FIG. 7 is a cross sectional view taken along a line B-B of FIG.6 illustrating an inner portion of the electrical connector.

The first connecting portion 32 extends out of the tongue 103 and contacts the inner shielding shell 5 so as to establish an electrical connection. Referring to FIG. 7, in the embodiment, the first connecting portion 32 comprises two protruding tabs protruding outwards from two sides of the main body 31 and extending out of the tongue 103.

The second connecting portion 33 extends out of the side wall 104 and is electrically connected with the outer shielding shell 4. Referring to FIG. 7, in the embodiment, the second connecting portion 33 comprises two elastic arms inclinedly extending outwards and rearwards from two sides of a rear part of the main body 31 respectively, ends of the two elastic arms elastically abut against an inner wall of the outer shielding shell 4 (in FIG. 7, the second connecting portion 33 is in a state that the second connecting portion 33 extends freely, therefore the second connecting portion 33 is slightly interferenced with the outer shielding shell 4), so as to establish a grounding path with the outer shielding shell 4.

The two elastic contact arms 34 are bent rearwards from a rear end of the main body 31, respectively extend into the two positioning grooves 108 at an inner side of the side wall 104 of the insulative body 101 (referring to FIG. 8), such a structure design can sufficiently use the space of the electrical connector and is beneficial to miniaturation of the electrical connector. The two elastic contact arms 34 elastically abut against the lower mating surface of the inserted portion 82 of the circuit board 8, and are electrically connected to the conductive pads 821 for grounding respectively, so that the grounding metal plate 3 can provide a grounding path connecting the circuit board 8 via the two elastic contact arms 34, which is beneficial to transmission of high frequency signals and improve electromagnetic compatibility (EMC) of the electrical connector 10.

In addition, a left side and a right side of the main body 31 of the grounding metal plate 3 are exposed out of the latching grooves 105 respectively and can be electrically connected with grounding elastic tabs (not shown) at two side surfaces of another mating connector, which is beneficial to transmission of high frequency signals. The main body 31 of the grounding metal plate 3 is provided with two through holes 311 penetrating along the up-down direction. The through hole 311 corresponds to the second fixing hole 117 of the first insulative piece 11 and the second protruding post 217 of the second insulative piece 21, so that the second protruding post 217 can pass through the through hole 311 of the grounding metal plate 3 and is fixed in the second fixing hole 117 and at the same time the grounding metal plate 3 is positioned.

The outer shielding shell 4 is fixed on insulative body 101, surrounds an outer space of the tongue 103 in the front of the insulative body 101 to define a first mating cavity 41 for insertion of the mating connector. The outer shielding shell 4 further surrounds two side walls 104 in the rear of the insulative body 101 to define a second mating cavity 42. The second mating cavity 42 surrounds the elastic extending arms 123 of the first conductive terminals 12 and the elastic extending arms 223 of the second conductive terminal 22 therein, can function as shielding. The insertion space 421 and the two positioning grooves 108 are positioned in the middle of the second mating cavity 42 along the up-down direction. The plate-like extending arms 122 of the first conductive terminals 12 and the plate-like extending arms 222 of the second conductive terminals 22 are provided as facing symmetry along the up-down direction in the first mating cavity 41 and are in 180 degrees rotational symmetry, so that whether another mating connector is properly inserted or is reversed by 180 degrees and inserted, the electrical connector 10 and the mating connector can be mated with each other.

A locking arm 43 provided with a locking hole 431 transversally extends outwards from each of two sides of the outer shielding shell 4. It should be noted that, by that the mounting hole 86 of the circuit board 8 is grounded, the outer shielding shell 4 may be reliably further grounded via the locking arm 43, which is beneficial to transmission of high frequency signals and improve electromagnetic compatibility of the electrical connector 10.

The inner shielding shell 5 is interposed between the outer shielding shell 4 and the first base portion 111 and the second base portion 211, and at least covers a rear section of the tongue 103 and the front surface 109 of the base 102 facing the first mating cavity 41.

In the embodiment, the inner shielding shell 5 comprises two metal plates 53 assembled with each other. The two metal plates 53 are respectively fixed on an upper side and a low side of the insulative body 101.

Two fixed protruding tabs 536 are respectively formed by bending a left side and a right side of the metal plate 53 at positions corresponding to the receiving grooves 106. The first connecting portion 32 is inserted between the two fixed protruding tabs 536 of the two metal plates 53 so as to contact the inner shielding shell 5 and in turn establish an electrical connection. Preferably, the first connecting portion 32 of the grounding metal plate 3 is fixed to the inner shielding shell 5 via laser welding, so as to enhance reliability of the electrical connection between the grounding metal plate 3 and the inner shielding shell 5. Such a structure additionally provides a grounding path for the grounding metal plate 3, which is beneficial to transmission of high frequency signals and improve electromagnetic compatibility of the electrical connector 10.

In addition, the metal plate 53 is formed with a connecting elastic tab 537 which can elastically contact the outer shielding shell 4, so that the inner shielding shell 5 may be grounded via the connecting elastic tab 537 and the outer shielding shell 4, which is beneficial to transmission of high frequency signals and improve electromagnetic compatibility of the electrical connector 10.

An assembling process of the electrical connector 10 of the present disclosure generally comprises steps of: forming the conductive terminals 12, 22, the grounding metal plate 3, the outer shielding shell 4 and the metal plates 53 by punching and bending; then forming the first terminal module 1 and the second terminal module 2 by insert molding; next mounting the grounding metal plate 3 between the first terminal module 1 and the second terminal module 2, and combining the first terminal module 1 with the second terminal module 2 so as to obtain the combined body 100; next mounting the two metal plates 53 respectively at an upper side and a lower side of the combined body 100, and welding the grounding metal plate 3 and the two metal plates 53; finally sheathing the outer shielding shell 4 onto an outer periphery of the combined body 100 from front to rear.

When such an electrical connector 10 is combined with the circuit board 8, it only requires that: the inserted portion 82 of the circuit board 8 is inserted into the insertion space 421 of the second mating cavity 42 from the rear of the electrical connector 10, the elastic extending arms 123, 223 correspondingly contact the conductive pads 821, then the electrical connector 10 is adjusted in position so as to allow the electrical connector 10 is aligned with an opening of a casing of an electronic device, finally the electrical connector 10 is securely fastened to the two mounting portions 83 of the circuit board 8 by the fasteners 9. Therefore, mounting flexibility of the electrical connector 10 is improved.

The electrical connector 10 of the present disclosure establishes an electrical connection with the circuit board 8 via the elastic extending arms 123, 223 and the conductive pads 821 on the upper surface and the lower surface of the inserted portion 82, such an elastic contact may enhance connection reliability of the elastic extending arms 123, 223 and the conductive pads 821, and prevent empty soldering of the terminals 12,22; also, such an elastic contact may not require soldering, in turn may reduce negative effects on electrical performances of the electrical connector 10 due to high temperature of soldering, and may not have risk of solder cracking; in addition, such an elastic contact can allow the electrical connector 10 to be connected to the circuit board 8 in form of floating, may slightly adjust the electrical connector 10 and the circuit board 8 relative to each other in position, and such an elastic contact further cooperates with the locking structure of the electrical connector 10, which is beneficial to precise alignment of the electrical connector 10 with the opening of the casing of the electronic device, and in turn provide mounting flexibility.

Figure 14:
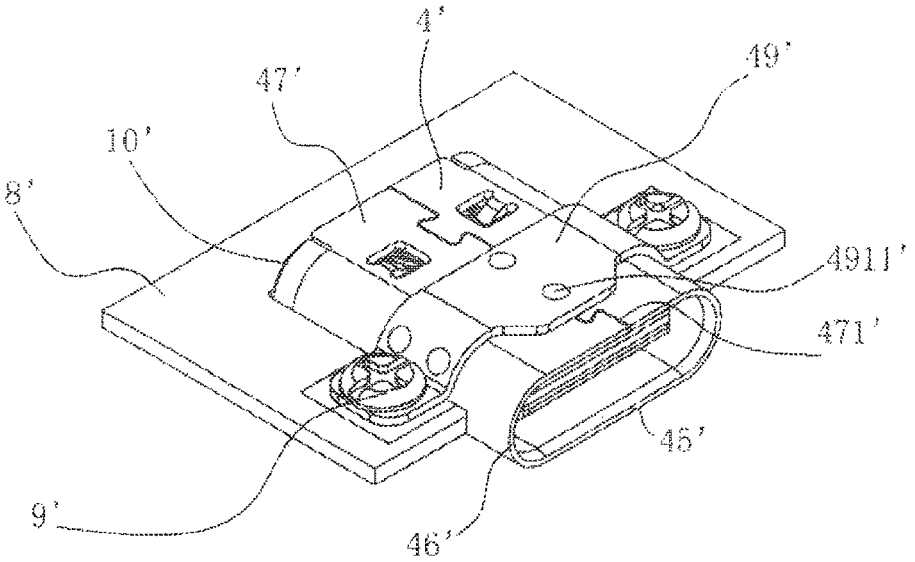
FIG. 14 is a perspective view illustrating another embodiment of an electrical connector combination of the present disclosure.
Figure 15:
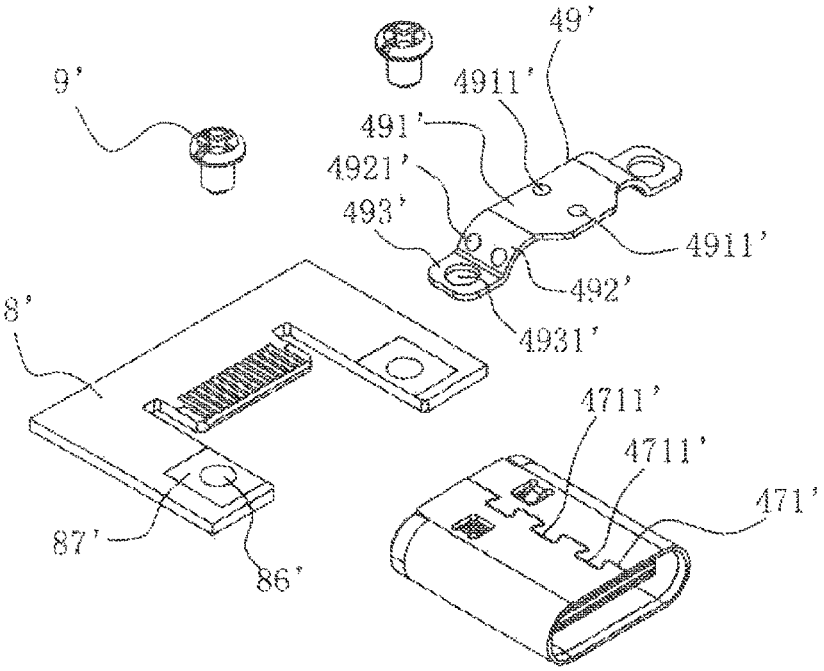
FIG. 15 is an exploded perspective view illustrating components of the electrical connector combination of FIG. 14.

Referring to FIG. 14 and FIG. 15, another embodiment of an electrical connector and an electrical connector combination of the present disclosure is illustrated. In the embodiment, differences of an outer shielding shell 4' of an electrical connector 10' from the outer shielding shell 4 lie in that: the outer shielding shell 4' comprises a bottom wall 45', two side walls 46' bent upwards respectively from two sides of the bottom wall 45' and extending, a top wall 47' formed by the two side walls 46' which extend toward each other and engage with each other. The top wall 47' is formed with an engaging slit 471'. The electrical connector 10' further comprises a locking piece 49' fixed on the outer shielding shell 4'.

In the embodiment, the top wall 47' is provided with a plurality of dovetail sections 4711' along the engaging slit 471', so that the dovetail sections 4711' are locked with each other. The locking piece 49' comprises a flat body portion 491', two side portions 492' respectively bent from two sides of the body portion 491' and extending, and two locking portions 493' further horizontally extending respectively from outer sides of the two side portions 492'. Each locking portion 493' is provided with a locking hole 4931'. The body portion 491' attaches on the top wall 47', the two side portions 492' respectively attach on the two side walls 46'. Preferably, the locking piece 49' is securely combined with the top wall 47' and the two side walls 46' via laser welding. The locking portion 493' and the locking hole 4931' is equivalent to the locking arm 43 and the locking hole 431 in function.

In the embodiment, laser joints 4911' of the locking piece 49' welded to top wall 47' correspond to the dovetail sections 4711' of engaging slits 471' in position. Laser joints 4921' of the locking piece 49' welded to the side walls 46' substantially correspond to the middle of the side walls 46' in position.

The circuit board 8' is formed with conducitve pads 87' around mounting holes 86'. In the embodiment, the electrical connector 10' may be locked to the circuit board 8' and electrically grounded via fasteners 9' each passing through the locking hole 4931' and the mounting hole 86'. However, in other embodiments, the locking hole 4931' of the locking portion 493' may be omitted, the electrical connector 10' may be securely combined with the circuit board 8' and electrically grounded by soldering the locking portion 493' to the conducitve pad 87' or adhering the locking portion 493' on the conducitve pad 87' with a conductive adhesive.

Such a design with the locking piece 49' may enhance structure strength of the outer shielding shell 4' and prevent the outer shielding shell 4' from cracking along the engaging slit 471', in addition may further maintain integral closeness of the outer shielding shell 4', improve electromagnetic compatibility of the electrical connector 10' and improve waterproofness of the electrical connector 10'

The above contents are only embodiments of the present disclosure and are not used to limit the implementing solution of the present disclosure, those skilled in the art may conveniently make corresponding variation or modification based on the main concept and spirit of the present disclosure, therefore the extent of protection of the present disclosure shall be determined by terms of the Claims.

What is claimed is:

1. An electrical connector, comprising:

an insulative body comprising a base, a tongue extending forwards from the base and two side walls extending rearwards respectively from two sides of the base, the tongue having a first mating surface and a second mating surface which are opposite along an up-down direction;

a group of first conductive terminals, each first conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the first mating surface of the tongue, the elastic extending arm being received between the two side walls;

a group of second conductive terminals, each second conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the second mating surface of the tongue, the elastic extending arm being received between the two side walls, an insertion space being formed between the elastic extending arms of the first conductive terminals and the elastic extending arms of the second conductive terminals;

a grounding metal plate provided in the tongue and spacing the first conductive terminals apart from the second conductive terminals; and an outer shielding shell fixed on the insulative body, defining a first mating cavity formed by surrounding an outer space of the tongue, and defining a second mating cavity formed by surrounding the two side walls, wherein the first conductive terminals and the second conductive terminals have identical configurations, are provided as facing one to one along an up-down direction and are in symmetry about a longitudinal plane defined by the insulative body.

2. The electrical connector according to claim 1, wherein each elastic extending arm of the conductive terminal comprises an elastic section inclinedly extending from a rear end of the fixed portion from front to rear and an engaging section provided at an end of the elastic section, the elastic section of the first conductive terminal and the elastic section of the second conductive terminal extend gradually close to each other along a front-rear direction.

3. The electrical connector according to claim 2, wherein each elastic extending arm of the conductive terminal further comprises a guiding section further inclinedly extending rearwards from the engaging section, wherein the guiding section of the first conductive terminal and the guiding section of the second conductive terminal extend gradually far away from each other along the front-rear direction.

4. The electrical connector according to claim 1, wherein a locking arm transversally extends outwards from each of two sides of the outer shielding shell, each locking arm is provided with a locking hole.

5. The electrical connector according to claim 1, wherein the electrical connector further comprises a locking piece, the locking piece comprises a body portion fixed on the outer shielding shell and two locking portions positioned respectively at two sides of the body portion.

6. The electrical connector according to claim 5, wherein the outer shielding shell is formed with an engaging slit, the body portion is fixed to the outer shielding shell at two sides of the engaging slit.

7. The electrical connector according to claim 1, wherein each of inner sides of two side walls of the insulative body is formed with a positioning groove extending along a front-rear direction, the positioning groove and the insertion space are positioned at the same height level and are communicated with each other.

8. The electrical connector according to claim 7, wherein the grounding metal plate is provided with some elastic contact arms bent rearwards, the elastic contact arm is positioned in the positioning groove.

9. The electrical connector according to claim 1, wherein the electrical connector further comprises an inner shielding shell surrounded by the outer shielding shell, the inner shielding shell covers a rear section of the tongue and a front surface of the base, and wherein the grounding metal plate comprises a main body provided in the tongue and a first connecting portion extending outwards from the main body, the first connecting portion extends out of the tongue and is electrically connected with the inner shielding shell, the grounding metal plate is electrically connected with the inner shielding shell and the outer shielding shell.

10. The electrical connector according to claim 1, wherein the grounding metal plate comprises a main body provided in the tongue and two elastic arms inclinedly extending outwards from two sides of the main body, the two elastic arms extend out of the insulative body and contact with the outer shielding shell.

11. The electrical connector according to claim 1, wherein the insulative body is formed by combining a first insulative piece and a second insulative piece with each other, and wherein the first conductive terminals are correspondingly fixed to the first insulative piece, and the second conductive terminals are correspondingly fixed to the second insulative piece, the grounding metal plate is interposed between the first insulative piece and the second insulative piece.

12. An electrical connector combination, comprising an electrical connector and a circuit board combined with each other, the electrical connector comprising:

an insulative body comprising a base, a tongue extending forwards from the base and two side walls extending rearwards respectively from two sides of the base, the tongue having a first mating surface and a second mating surface which are opposite along an up-down direction;

a group of first conductive terminals, each first conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the first mating surface of the tongue, the elastic extending arm being received between the two side walls;

a group of second conductive terminals, each second conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the second mating surface of the tongue, the elastic extending arm being received between the two side walls, an insertion space being formed between the elastic extending arms of the first conductive terminals and the elastic extending arms of the second conductive terminals;

a grounding metal plate provided in the tongue and spacing the first conductive terminals apart from the second conductive terminals; and an outer shielding shell fixed on the insulative body, defining a first mating cavity formed by surrounding an outer space of the tongue, and defining a second mating cavity formed by surrounding the two side walls;

wherein the first conductive terminals and the second conductive terminals have identical configurations, are provided as facing one to one along an up-down direction and are in symmetry about a longitudinal plane defined by the insulative body;

the circuit board being provided with an inserted portion, the inserted portion having two mating surfaces opposite along the up-down direction, each of the two mating surfaces being provided with a group of conductive pads;

the inserted portion of the circuit board being correspondingly inserted into the insertion space of the second mating cavity of the electrical connector, the conductive pads on the two mating surfaces of the inserted portion being elastically contacted by the elastic extending arms of the first conductive terminals and the elastic extending arms of the second conductive terminals so as to be correspondingly electrically connected.

13. The electrical connector combination according to claim 12, wherein each elastic extending arm of the conductive terminal comprises an elastic section inclinedly extending from a rear end of the fixed portion from front to rear and an engaging section provided at an end of the elastic section, the elastic section of the first conductive terminal and the elastic section of the second conductive terminal extend gradually close to each other along a front-rear direction.

14. The electrical connector combination according to claim 13, wherein each elastic extending arm of the conductive terminal further comprises a guiding section further inclinedly extending rearwards from the engaging section, the guiding section of the first conductive terminal and the guiding section of the second conductive terminal extend gradually far away from each other along the front-rear direction so as to guide the inserted portion of the circuit board to insert into the insertion space.

15. The electrical connector combination according to claim 12, wherein a locking arm transversally extends outwards from each of two sides of the outer shielding shell, each locking arm is provided with a locking hole, and wherein the circuit board is provided with two mounting portions at two sides of the inserted portion, a receiving channel is formed between each mounting portion and the inserted portion, each mounting portion is provided with a mounting hole corresponding to the locking hole, the electrical connector is locked to the circuit board via fasteners passing through the corresponding mounting holes and the corresponding locking holes.

16. The electrical connector combination according to claim 12, wherein the electrical connector further comprises a locking piece, the locking piece comprises a body portion fixed on the outer shielding shell and two locking portions positioned respectively at two sides of the body portion.

17. The electrical connector combination according to claim 16, wherein the outer shielding shell is formed with an engaging slit, the body portion is fixed to the outer shielding shell at two sides of the engaging slit, each of the two locking portions is provided with a locking hole, and wherein the circuit board is provided with two mounting portions at two sides of the inserted portion, a receiving channel is formed between each mounting portion and the inserted portion, each mounting portion is provided with a mounting hole corresponding to the locking hole, the electrical connector is locked to the circuit board via fasteners passing through the corresponding mounting holes and the corresponding locking holes.

18. The electrical connector combination according to claim 12, wherein each of inner sides of two side walls of the insulative body is formed with a positioning groove extending along a front-rear direction, the positioning groove and the insertion space are positioned at the same height level and are communicated with each other, so as to position two side edges of the inserted portion of the circuit board.

19. The electrical connector combination according to claim 18, wherein the grounding metal plate is provided with elastic contact arms bent rearwards, the elastic contact arm is positioned in the positioning groove and elastically abuts against the conductive pad on the inserted portion of the circuit board.

20. The electrical connector combination according to claim 12, wherein the electrical connector further comprises an inner shielding shell surrounded by the outer shielding shell, the inner shielding shell covers a rear section of the tongue and a front surface of the base, and wherein the grounding metal plate comprises a main body and a first connecting portion extending outwards from the main body, the first connecting portion extends out of the tongue and is electrically connected with the inner shielding shell, the grounding metal plate is electrically connected with the inner shielding shell and the outer shielding shell.

21. The electrical connector combination according to claim 12, wherein the grounding metal plate comprises a main body provided in the tongue and two elastic arms inclinedly extending outwards from two sides of the main body, the two elastic arms extend out of the insulative body and contact with the outer shielding shell.

22. The electrical connector combination according to claim 12, wherein the insulative body is formed by combining a first insulative piece and a second insulative piece with each other, and wherein the first conductive terminals are correspondingly fixed to the first insulative piece, and the second conductive terminals are correspondingly fixed to the second insulative piece, the grounding metal plate is interposed between the first insulative piece and the second insulative piece.

23. An electrical connector, comprising:

an insulative body comprising a base, a tongue extending forwards from the base and two side walls extending rearwards respectively from two sides of the base, the tongue having a first mating surface and a second mating surface which are opposite along an up-down direction;

a group of first conductive terminals, each first conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the first mating surface of the tongue, the elastic extending arm being received between the two side walls;

a group of second conductive terminals, each second conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the second mating surface of the tongue, the elastic extending arm being received between the two side walls, an insertion space being formed between the elastic extending arms of the first conductive terminals and the elastic extending arms of the second conductive terminals;

an outer shielding shell fixed on the insulative body, defining a first mating cavity formed by surrounding an outer space of the tongue, and defining a second mating cavity formed by surrounding the two side walls;

an inner shielding shell surrounded by the outer shielding shell, the inner shielding shell covers a rear section of the tongue and a front surface of the base; and a grounding metal plate provided in the tongue and spacing the first conductive terminals apart from the second conductive terminals, the grounding metal plate comprises a main body provided in the tongue and a first connecting portion extending outwards from the main body, the first connecting portion extends out of the tongue and contacts the inner shielding shell so as to establish an electrical connection.

24. An electrical connector combination, comprising an electrical connector and a circuit board combined with each other, the electrical connector comprising:

an insulative body comprising a base, a tongue extending forwards from the base and two side walls extending rearwards respectively from two sides of the base, the tongue having a first mating surface and a second mating surface which are opposite along an up-down direction;

a group of first conductive terminals, each first conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the first mating surface of the tongue, the elastic extending arm being received between the two side walls;

a group of second conductive terminals, each second conductive terminal comprising a fixed portion fixed in the base, a plate-like extending arm extending forwards from the fixed portion to the tongue and an elastic extending arm extending rearwards from the fixed portion and extending out of the base, the plate-like extending arm being exposed on the second mating surface of the tongue, the elastic extending arm being received between the two side walls, an insertion space being formed between the elastic extending arms of the first conductive terminals and the elastic extending arms of the second conductive terminals;

an outer shielding shell fixed on the insulative body, defining a first mating cavity formed by surrounding an outer space of the tongue, and defining a second mating cavity formed by surrounding the two side walls;

an inner shielding shell surrounded by the outer shielding shell, the inner shielding shell covers a rear section of the tongue and a front surface of the base; and a grounding metal plate provided in the tongue and spacing the first conductive terminals apart from the second conductive terminals, the grounding metal plate comprises a main body provided in the tongue and a first connecting portion extending outwards from the main body, the first connecting portion extends out of the tongue and contacts the inner shielding shell so as to establish an electrical connection;

the circuit board being provided with an inserted portion, the inserted portion having two mating surfaces opposite along the up-down direction, each of the two mating surfaces being provided with a group of conductive pads;

the inserted portion of the circuit board being correspondingly inserted into the insertion space of the second mating cavity of the electrical connector, the conductive pads on the two mating surfaces of the inserted portion being elastically contacted by the elastic extending arms of the first conductive terminals and the elastic extending arms of the second conductive terminals so as to be correspondingly electrically connected.

* * * * *